US012529279B2

(12) United States Patent
Byberg

(10) Patent No.: US 12,529,279 B2
(45) Date of Patent: Jan. 20, 2026

(54) SPEAR AND PACKER TOOL, AN ASSEMBLY COMPRISING SAID TOOL, AND A METHOD FOR USING SAID TOOL AND SAID ASSEMBLY

(71) Applicant: Archer Oiltools AS, Stavanger (NO)

(72) Inventor: Arve Byberg, Klepp Stasjon (NO)

(73) Assignee: ARCHER OILTOOLS AS, Stavanger (NO)

( * ) Notice: Subject to any disclaimer, the term of this patent is extended or adjusted under 35 U.S.C. 154(b) by 0 days.

(21) Appl. No.: 18/712,409

(22) PCT Filed: Nov. 23, 2022

(86) PCT No.: PCT/NO2022/050269
§ 371 (c)(1),
(2) Date: May 22, 2024

(87) PCT Pub. No.: WO2023/096496
PCT Pub. Date: Jun. 1, 2023

(65) Prior Publication Data

US 2025/0003306 A1 Jan. 2, 2025

(30) Foreign Application Priority Data

Nov. 23, 2021 (NO) ..... 20211424

(51) Int. Cl.
*E21B 31/16* (2006.01)
*E21B 29/00* (2006.01)
*E21B 31/20* (2006.01)

(52) U.S. Cl.
CPC ..... *E21B 31/16* (2013.01); *E21B 29/005* (2013.01); *E21B 31/20* (2013.01)

(58) Field of Classification Search
CPC ..... E21B 31/16; E21B 29/005; E21B 31/20
See application file for complete search history.

(56) References Cited

U.S. PATENT DOCUMENTS 1,765,864 A 6/1930 Corey
10,151,164 B2 * 12/2018 Bennett ..... E21B 29/005
(Continued)

FOREIGN PATENT DOCUMENTS

EP 3 494 277 A1 6/2019
WO WO 2018/083473 A1 5/2018
WO WO 2020/095043 A1 5/2020

OTHER PUBLICATIONS

International Preliminary Report on Patentability, issued in PCT/NO2022/050269, dated Jan. 25, 2024.
(Continued)

*Primary Examiner* — Neel Girish Patel
(74) *Attorney, Agent, or Firm* — Birch, Stewart, Kolasch & Birch, LLP

(57) ABSTRACT

A spear and packer tool is arranged for being conveyed on a drill pipe string. The tool has a mandrel having a through bore, a spear anchor mechanism configured to grip a section of casing in a wellbore for removal therefrom, the spear anchor mechanism being arranged to be set by differential pressure, said spear anchor mechanism being rotational relative to the mandrel, and a packer assembly being a mechanical rotational-set retrievable packer configured to seal an annulus between the spear and packer tool and the casing. The packer assembly is arranged to be set by applying left hand rotation to the mandrel while the slips segments are engaging the casing, the packer assembly being arranged below the spear anchor mechanism. A downhole casing cutting and retrieval assembly including the spear and packer tool and a method for operating the tool and assembly are disclosed.

20 Claims, 4 Drawing Sheets

(56) References Cited

U.S. PATENT DOCUMENTS

| | | | | |
|---|---|---|---|---|
| 11,408,241 | B2 * | 8/2022 | Cullum | E21B 31/16 |
| 2002/0162659 | A1 * | 11/2002 | Davis | E21B 29/005 166/361 |
| 2003/0205377 | A1 * | 11/2003 | Streater | E21B 31/20 166/301 |
| 2015/0226031 | A1 | 8/2015 | Hekelaar | |
| 2018/0100373 | A1 * | 4/2018 | Krüger | E21B 29/002 |
| 2018/0171749 | A1 * | 6/2018 | Yue | E21B 33/1293 |
| 2018/0216432 | A1 * | 8/2018 | Nelson | E21B 29/002 |
| 2019/0257168 | A1 * | 8/2019 | Sunde | E21B 29/002 |
| 2020/0232295 | A1 * | 7/2020 | Telfer | E21B 17/07 |
| 2021/0032948 | A1 * | 2/2021 | Stewart | E21B 23/01 |
| 2021/0277735 | A1 * | 9/2021 | Fagna | E21B 33/134 |
| 2022/0034182 | A1 * | 2/2022 | Cullum | E21B 23/01 |

OTHER PUBLICATIONS

International Search Report, issued in PCT/NO2022/050269, dated Feb. 2, 2023.
Norwegian Search Report, issued in Priority Application No. 20211424, dated Mar. 31, 2022.
Written Opinion of the International Searching Authority, issued in PCT/NO2022/050269, dated Feb. 2, 2023.

* cited by examiner

SPEAR AND PACKER TOOL, AN ASSEMBLY COMPRISING SAID TOOL, AND A METHOD FOR USING SAID TOOL AND SAID ASSEMBLY

FIELD OF THE INVENTION

The present invention relates to a downhole spear and packer tool, a toolstring including the spear and packer tool, and a method for operating said tool and toolstring.

BACKGROUND OF THE INVENTION

Prior art relating to the field of the invention includes:

WO2020095043A1 relates to a method for use in retrieving casing from a wellbore comprises running a tool string having a casing cutter, a casing anchor and a jarring apparatus into the cased wellbore, operating the casing anchor to anchor the tool string to the casing and operating the casing cutter to cut through the casing to divide an upper casing portion from a lower casing portion. The method further comprises applying tension to the tool string to apply a pulling force on the upper casing portion and to configure the jarring apparatus into a jarring configuration, and generating repeated jarring forces within the jarring apparatus while applying tension within the tool string.

EP3494277A1 relates to a method and apparatus for removing a downhole casing from a well on a single trip. A downhole tool assembly is arranged on a work string having a downhole pull tool, a spear tool, motor unit and cutting device. The downhole pull tool is set inside a first casing string and the spear tool, motor unit and cutting device are located inside a second casing string, located through the first casing string. The downhole pull tool and spear tool can be configures to grip the respective casings during cutting of the second casing string. The cut casing section can then be pulled using the downhole pull tool to dislodge the casing section, whereupon via attachment to the spear tool, the cut casing section can be removed from the well. The assembly can be re-set at shallower depths in the event that the cut casing section cannot be dislodged for removal.

U.S. Pat. No. 1,765,864A relates to oil well fishing tools and more particularly to a trip casing spear oil well rotary fishing tool.

US20150226031A1 relates to a multi-stage flow sub usable in wellbore operations provides for flow of fluid from a tool string to a wellbore annulus, and may provide for one or more of controlling wellbore pressure during a tool operation, or preventing stripping of wet string. The multi-stage flow sub may include a housing having an axial bore and at least one flow passage. A sleeve within the housing may have an axial bore, a shoulder acting as a ball seat, and first and second axially offset flow passages. A first burst disc may be in fluid communication with the first flow passage, and a second burst disc may be in fluid communication with the second flow passage, the second burst disc having a higher burst pressure than the first burst disc.

Increasing the efficiency of a well operation is often related to reducing the rig time and in particular reducing the time spent on tripping in and out of the well to perform a particular operation. Getting more done on each run will reduce the number of runs needed and therefore time spent tripping and time spent rigging up and down the toolstring/BHA on surface. Historically, cutting and freeing a stuck tubular in a well would require more than one run, so reducing the number of runs has always been important. Likewise, is providing more options in the form of tools, toolstrings and methods to have options that are suitable to meet challenges which may occur in the variety of situations in well operations.

SUMMARY OF THE INVENTION

In one aspect the invention is a spear and packer tool, said tool arranged for being conveyed on a drill pipe string, said tool having a mandrel having a through bore, a spear anchor mechanism configured to internally grip a section of casing in a wellbore for removal therefrom, said spear anchor mechanism is arranged to be set by differential pressure, said spear anchor mechanism being rotational relative to the mandrel, (the mandrel may rotate while the spear anchor mechanism is engaged with the casing) and a packer assembly being a mechanical rotational-set retrievable packer configured to seal an annulus between the spear and packer tool and the casing, said packer assembly is arranged to be set by applying left hand rotation to the mandrel while the slips segments are engaged with the casing, said packer assembly being arranged below the spear anchor mechanism.

The spear and packer tool provides the possibility to rotate a workstring such as a rotating cutter tool below the spear and packer tool while the spear anchor mechanism of the spear and packer tool is engaged. At the same time a mechanical rotational-set retrievable/releasable packer is provided that can seal off the annulus between the spear and packer tool and the casing when the spear is engaged. This allows pressure testing through e.g. a cut made in the casing to the casing annulus.

These features extend the possibilities for operators of wells to combine tools, operations and runs.

The spear anchor mechanism can comprise:

slips segments arranged to engage an inner surface of the casing to be removed, a ramp assembly arranged to force the slips segments radially outwards when axially forced, a differential pressure piston arranged to force the slips segments axially towards and onto the ramp assembly as a result of a pressure increase via a radial channel from the through bore, and a bias element arranged to return said differential pressure piston to enable said slips segments to disengage from said casing.

The packer assembly can comprise:

a compresser sleeve arranged slidable on the mandrel, a ring shaped packer element arranged around the mandrel to be compressed axially to expand radially to seal the annulus, the packer element is arranged between a stop flange on the mandrel and the compresser sleeve, a segmented ring comprising:

three or more ring segments, having ring threads on an inner surface, the ring threads arranged for being threaded onto matching mandrel threads on an outside of the mandrel, means for rotationally locking the segmented ring to the slips segments, so that the segmented ring is screwed along the mandrel threads when the mandrel is rotated relative to the slips segments to axially move the segmented ring along the mandrel, and a biasing member encircling the segmented ring to hold the ring segments together with a radially inward directed biasing force, a stopper element which is fixed to the mandrel in the axial direction to limit the proximal movement of the segmented ring.

wherein the ring threads have a slanted face arranged to face an opposite corresponding slanted face on the mandrel threads, so that when the segmented ring is screwed and moves proximally and hits the stopper element, the ring threads disengage from the radially underlying mandrel threads.

The segmented ring is rotationally locked relative to the slips segments, such as to a barrel holding the slips segments. Rotationally locking the segmented ring to the slips segments so that they do not rotate relative to each other can be done in several ways. On possible solution is to arrange a pin or other member protruding out from one or more of the ring segments. This protruding member is arranged to slide in a groove in a sleeve surrounding the segmented ring, and the surrounding sleeve is locked to the anchor mechanism and can rotate relative to the mandrel. The purpose of this mechanism is to allow the segmented ring to move axially relative to the slips and the mandrel, and to be able to rotate relative to the mandrel but not relative to the slips segments so that the segmented ring is screwed along axially on the mandrel when the slips are engaged with the casing inner wall.

Further the threads on the mandrel and on the segmented ring are mutually arranged so that left hand rotation of the mandrel will move the segmented ring distally towards the compresser sleeve, and so that right hand rotation will move the segmented ring proximally away from the compresser sleeve and in a direction towards the stopper element.

The ring threads have a slanted face arranged to face an opposite corresponding slanted face on the mandrel threads. Due to this, right-hand rotation of the mandrel, after the segmented ring hits the stopper element, will result in a mutual separation of the ring segments, so that the ring threads disengages from the underlying mandrel threads. Due to this disengagement of the threads, further right-hand rotation of the mandrel is possible without further proximal movement of the segmented ring.

In an embodiment of the invention the spear and packer tool can comprise a second set of slips, the second set of slips is arranged to be set by the same left-hand rotation of the mandrel as the packer element.

The person skilled in the art will know that left-hand rotation may alternatively be exchanged with right-hand rotation, but below it will become clear that we would prefer to set the packer and the second set of slips by LH rotation due to the fact that we would like to rotate right-hand for releasing the packer and secondary slips and particularly for running a rotating cutter tool, and RH rotation is preferred for that operation because RH is the normal rotation direction for a drill pipe string in order to avoid accidentally unscrewing the drillpipe string joints.

In an embodiment of the invention the second set of slips are arranged around the mandrel between the compresser ring and a separation ramp ring slidably arranged on the mandrel. The second set of slips is arranged so that when the segmented ring is screwed and moving distally, pushing onto the compresser ring, the slips segments of the second set of slips are forced radially outwards by the separation ramp ring. The separation ramp ring is also moved distally while the second set of slips segments are forced radially so that the packer element is compressed and will eventually seal of the annulus within the casing.

An advantage of the second set of slips is that they secure the grip of the spear and packer tool in situations where the grip of the slips segments of the spear is otherwise lost. For instance if the spear is not held in tension by the workstring and there is no differential pressure to operate the differential pressure piston the spear will loose its grip if the spear and packer tool did not have the second sets of slips holding the spear and packer tool in place.

The spear and packer tool can be equipped with one or more thrust bearing to absorb forces that arise in the tool while the mandrel rotates relative to the slips segments. The person skilled in the art will know how to provide design for thrust bearings that can handle that the mandrel is rotating at the same time as the spear anchor mechanism is engaged with in the casing and held in tension.

In another aspect the invention relates to a downhole casing cutting and retrieval assembly carried on a work string, having a bore therethrough. The downhole casing cutting and retrieval assembly comprises:

the spear and packer tool, and a cutter mechanism configured to cut the casing, to separate a cut-off casing section from the casing. The cutter mechanism is arranged below the spear and packer tool.

The mandrel of the spear and packer tool is arranged to be left-hand rotated in order to set the packer, and the mandrel is arranged to be right-hand rotated in order to unset the packer. In an embodiment the spear and packer tool is connected to the cutter mechanism which is arranged to cut off a section of the casing using of right-hand rotation of the workstring.

In an embodiment of the invention the downhole casing cutting and retrieval assembly can further comprise a downhole jack. The downhole jack comprises a jack anchor arranged to engage and hold a casing of larger diameter relative to the cut-off casing section, above the top of said cut-off casing section. The jack is arranged to pull free the cut-off casing section, by pulling upward the engaged spear anchor mechanism towards the set jack anchor, when the spear anchor mechanism is set in the cut-off casing section.

In an embodiment of the invention a ball valve tool is arranged below the spear and packer tool and above the cutter mechanism. The ball calve tool is be arranged for closing the through bore of the workstring after cutting. This is to enable setting pressure in the drill pipe string to operate said downhole jack and jack anchor to pull free the cut-off casing section.

In yet another aspect the invention relates to a method for cutting a casing, and retrieving a cut-off casing section. The method comprises the steps of:

a) running the downhole casing cutting and retrieval assembly on a workstring into a wellbore, b) entering a top portion of a casing to be cut and retrieved with the casing cutting and removal assembly, c) pressure setting the anchor mechanism of the spear in the casing by pumping in said workstring with a flowrate above a predetermined level, d) hold the workstring in tension to keep the slips segments of the spear anchor mechanism engaged to the casing (with the workstring and mandrel in tension the anchor mechanism will stay engaged with the casing without the need to maintain the flowrate above the predetermined level), e) rotating the workstring in the right-hand direction to cut the casing, while circulating well fluid via the tool annulus past said anchor mechanism, f) when said casing is cut, stop the right-hand rotation of the workstring, g) rotate the workstring in the left-hand direction to set the packer assembly, h) set pressure in said workstring, and i) monitor pressure and return flow from the wellbore for the purpose of evaluating whether the cut-off casing section is free.

If there is no return flow then the cut-off casing section is most likely stuck. If some return is seen then there is a chance that maintaining that circulating will wash out debris from behind the cut-off casing section so that it loosens or is released. Depending on the outcome of the circulation-/pressure-test it might be needed to continue with some or all the steps described below.

The method can further comprise the steps of:

j) releasing the spear anchor mechanism and the packer mechanism if not previously released, k) pulling the casing cutting and retrieval assembly proximally until the spear anchor mechanism is in the top portion of the cut off casing section, l) setting the spear anchor mechanism in the top portion of the cut off casing section, m) determining whether the cut-off casing section is stuck in its casing annulus by pulling on the workstring from surface, n) if so, setting the jack anchor in a casing of larger diameter than the cut-off casing section, above said top of said cut-off section, and o) operating the jack tool for pulling the spear anchor mechanism, for pulling the cut-off casing section, towards the jack anchor.

The packer element is retracted by applying right hand rotation to the mandrel via the workstring.

DESCRIPTION OF THE FIGURES

Embodiments of the present invention will now be described, by way of example only, with reference to the following figures, wherein:

FIG. 1 shows the assembly before the cut is made and the packer element is sealing off the tool annulus. At this point in the operation any fluid pumped down the workstring will return via the tool annulus.

| Reference numbers | |
|---|---|
| 1 | Wellbore |
| 2 | Casing |
| 2.1 | Cut off casing section |
| 3 | Top portion of casing (top of casing to be removed) |
| 4 | Cut (cut made in casing) |
| 5 | Annulus (tool annulus) |
| 6 | Workstring |
| 7 | Through bore (of workstring) |
| 8 | Outer casing |
| 10 | Spear and packer tool |
| 11 | Mandrel |
| 11.1 | Stop flange (flange on mandrel for holding the packer element from sliding off the mandrel when compressed) |
| 11.2 | Mandrel threads |
| 12 | Through bore (of mandrel) |
| 13 | Radial channel |
| 14 | Top sub |
| 20 | Spear |
| 21 | Spear anchor mechanism |
| 22 | Slips segments |
| 23 | Ramp assembly (of anchor mechanism) |
| 24 | Differential pressure piston |
| 25 | Bias element (can be in the form of a return spring) |
| 30 | Packer assembly |
| 31 | Packer element |
| 32 | Segmented ring |
| 32.1 | Ring segment |
| 32.2 | Ring threads |
| 32.3 | Biasing member |
| 33 | Compresser sleeve |
| 34 | Stopper element/thrust bearing for outer sleeve 38 |
| 35 | Second set of slips |
| 36 | Separation ramp ring |

-continued

| Reference numbers | |
|---|---|
| 37 | Protruding pin (pin to slide in a groove in a surrounding sleeve to rotationally fix the segmented ring relative to the slips segments and at the same time allow for axial movement relative to the slips segments and the mandrel) |
| 38 | Outer sleeve |
| 40 | Cutter mechanism |
| 50 | Downhole jack |
| 51 | Jack anchor |
| 60 | Ball valve tool |
| 80 | Arrow indicating circulation path before casing 2 is cut and packer element is set |
| 90 | Arrow indicating circulation path after casing 2 is cut and packer element is set |
| 100 | Downhole casing cutting and removal assembly (a toolstring) |

DESCRIPTION OF EMBODIMENTS OF THE INVENTION

Figure 3:
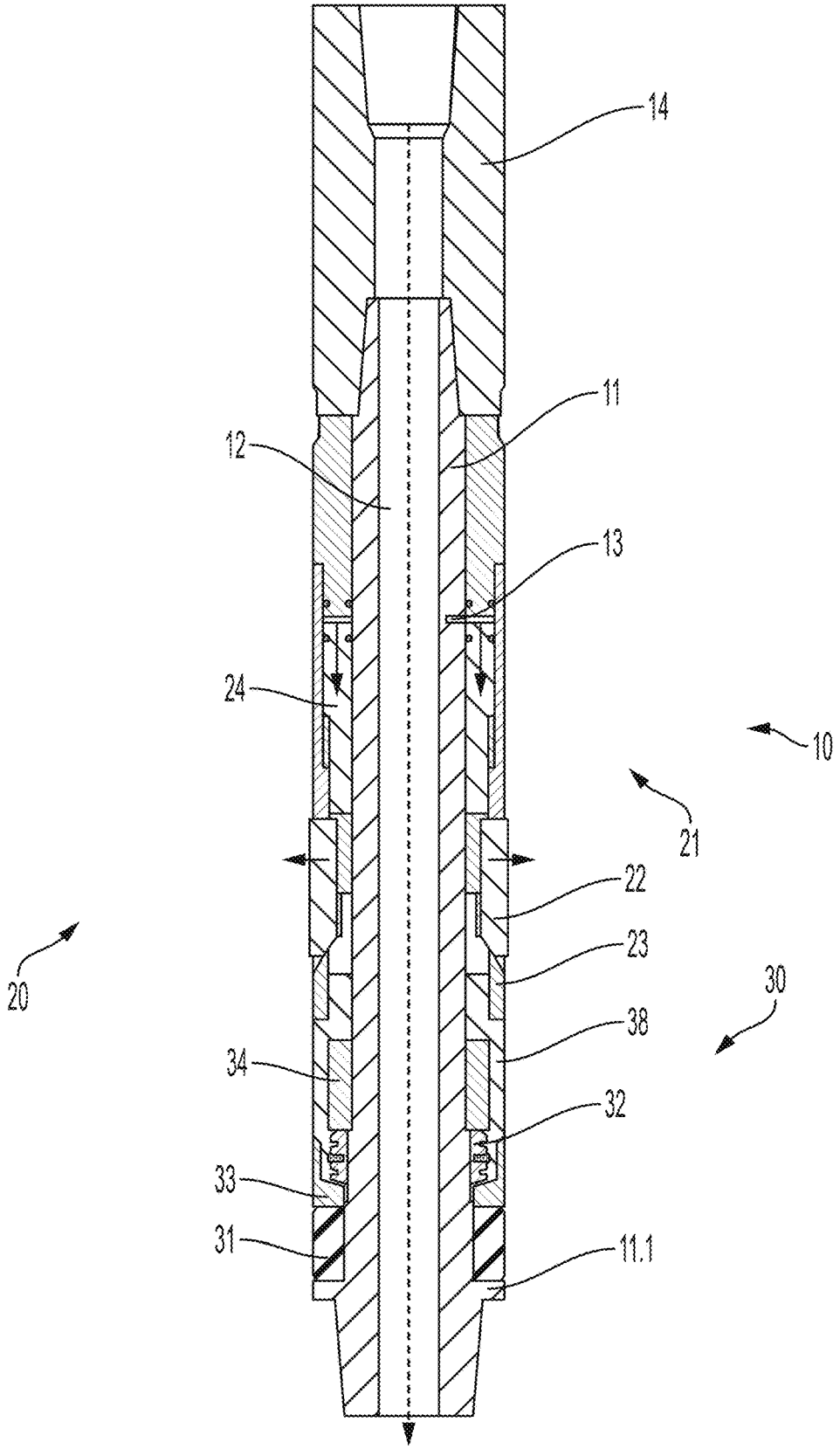
FIG. 3 shows an embodiment of the spear and packer tool before the anchor mechanism and the packer assembly are set. Arrows indicating fluid flow in the mandrel and in the radial channels, and two other arrows indicating where the slips will push when activated by differential pressure. The bias element that returns the differential pressure piston is not visible in this figure. The bias element will be arranged in the anchoring mechanism as seen in FIG. 5. The packer element is here shown in a retracted, unset position.

In an advantageous embodiment of the invention as seen in FIG. 3 the spear and packer tool 10 comprises a spear 20 and a packer assembly 30. The spear 20 is arranged to grip the inner wall of a casing 2. The packer assembly 30 is arranged to set a packer element 31 to seal off the tool anulus 5. Both the spear 20 and the packer assembly 30 are arranged on a mandrel 11 with a through bore 12. In an embodiment the mandrel 11 is screwed into a top sub 14 which is arranged with a box connection while a distal end of the mandrel is arranged with a pin connection.

The spear 20 comprises an anchor mechanism 21 arranged to engage and grip the inner surface of the casing 2 as a result of a differential pressure between the through bore 12 and the annulus 5 surrounding the tool 10. The anchor mechanism 21 comprises slips segments 22 to grip the casing 2, a differential pressure piston 24 for moving the slips segments 22 axially, a ramp assembly 23 for pushing the slips segments 22 radially outwards when axially displaced and a bias element 25 (not visible in FIG. 3) to exert a return force on the differential pressure piston 24 to its starting position. A proximal end of the differential pressure piston 24 is a piston area in fluid communication with the through bore 12 of the mandrel 11 via pressure relief radial channels 13. An opposite piston area is in fluid communication with the tool annulus 5.

Differential pressure to overcome the biasing force of the biasing element 25 is achieved by pumping fluid pressure in a connected workstring 6 with a pump rate above a predetermined level. The pressure differential in a circulation flow between the through bore 12 and the annulus 5 will provide the required differential pressure. As will be described later, tools such as a valve tool, a restriction valve tool, or a cutter mechanism 40 can be included in a toolstring/assembly distal to the spear and packer tool 10. Such tools can increase the pressure drop from the through bore 12 to the annulus 5.

The packer assembly 30 comprises a packer element 31, a segmented ring 32, a compresser sleeve 33 and a stopper element 34. The stopper element 34 is fixed to the mandrel 11 in the axial direction and may form an axial (and radial) bearing for the outer sleeve 38. The packer assembly 30 further comprises stop flanges 11.1 on the mandrel 11 for holding the packer element 31 from sliding off the mandrel 11 when compressed.

Figure 5:
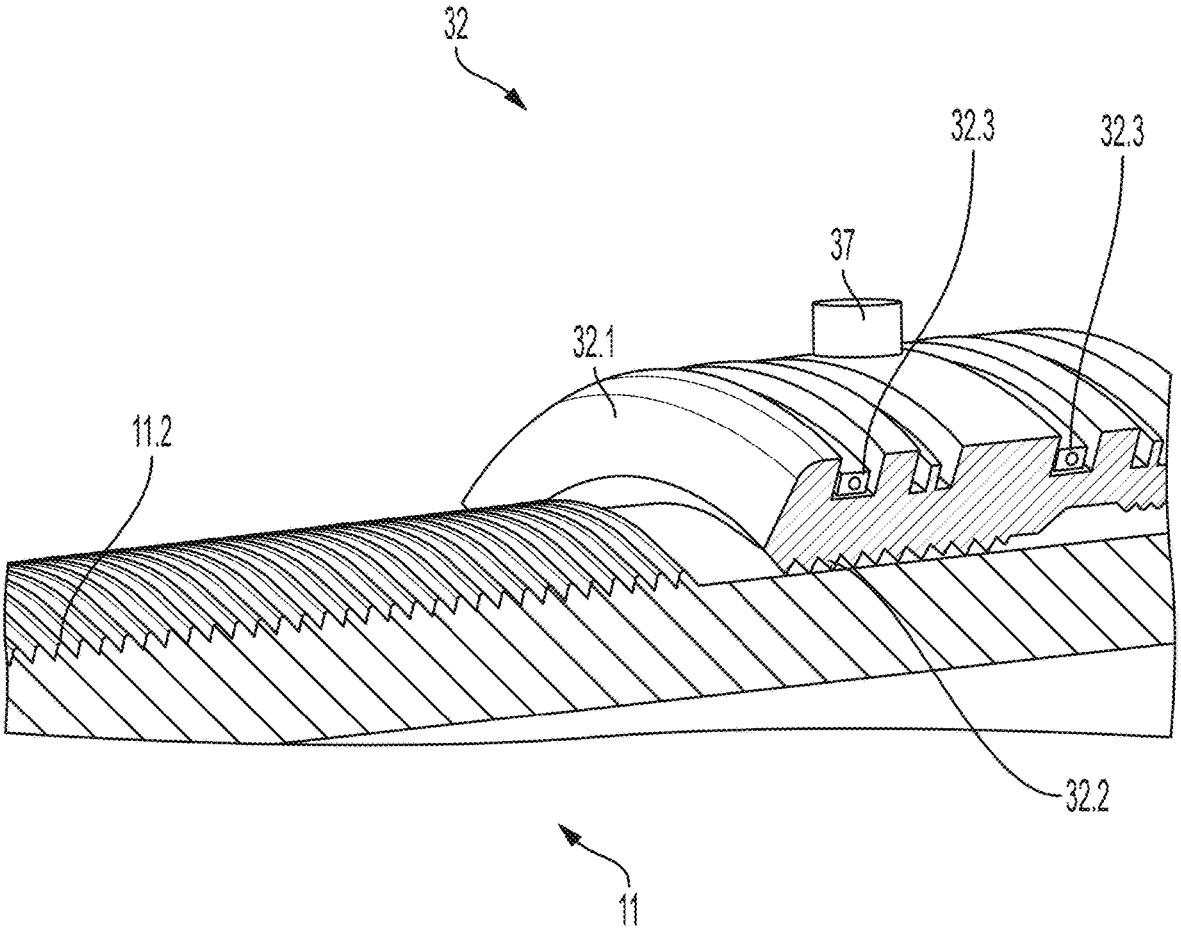
FIG. 5 shows a close-up view of the segmented ring placed on the mandrel. The profiles of the ring threads and the mandrel threads have matching slanted faces are seen. Also, the biasing members for holding the individual segments of the segmented ring together is seen. The ring threads are not engaged with the mandrel threads in this figure, this is simply to show the threads and their slanting more clearly.

The segmented ring 32 further comprises three or more ring segments 32.1 with ring threads 32.2. The ring segments 32.1 are held together as a ring around the mandrel 11 by one or more inwardly biasing members 32.3 such as ring-shaped springs. A protruding pin 37 protrudes outwards from the segmented ring into an axially directed groove in an inner face of an outer sleeve 38. The outer sleeve 38 is rotationally locked to the slips segments 22 and can rotate relative to the mandrel 11, i.e. the mandrel 11 is rotated leftward or rightward relative to the slips segments 22 when they are engaged in the casing wall (and thus not rotating). The ring threads 32.2 are in engagement with mandrel threads 11.2. Left-hand rotation of the mandrel 11, relative to the slips segments 22 (and the outer sleeve 38), will lead to a distally directed movement of the segmented ring 32 relative to the mandrel 11 as it is screwed on the mandrel threads 11.2. The ring threads 32.2 and the mandrel threads 11.2 each has threads with a slanted face that are mutually facing each other. Right-hand rotation after the segmented ring 32 is screwed to its most proximal position where it is axially stopped by the stopper element 34 will lead to a separation of the ring segments 32.1 so that the ring threads 32.2 disengage from the mandrel threads 11.2 and allow for further right-hand rotation of the mandrel 11 relative to the slips segments 22. This is needed to allow the mandrel 11 to rotate in the right-hand direction in case the slips segments 22 is engaged to a casing 2. A ring segment 32.1 is seen relative to the mandrel in a closer view in FIG. 5.

When the mandrel 11 is rotated left-hand, the segmented ring 32 will move in the distal direction and push the compresser sleeve 33 in the distal direction which further will compress the packer element 31. The packer element 31 will, as a result of the compression, expand into and seal off the tool annulus 5 toward the casing inner wall. To retract the packer element 31, right-hand rotation is applied to the mandrel 11.

Figure 4:
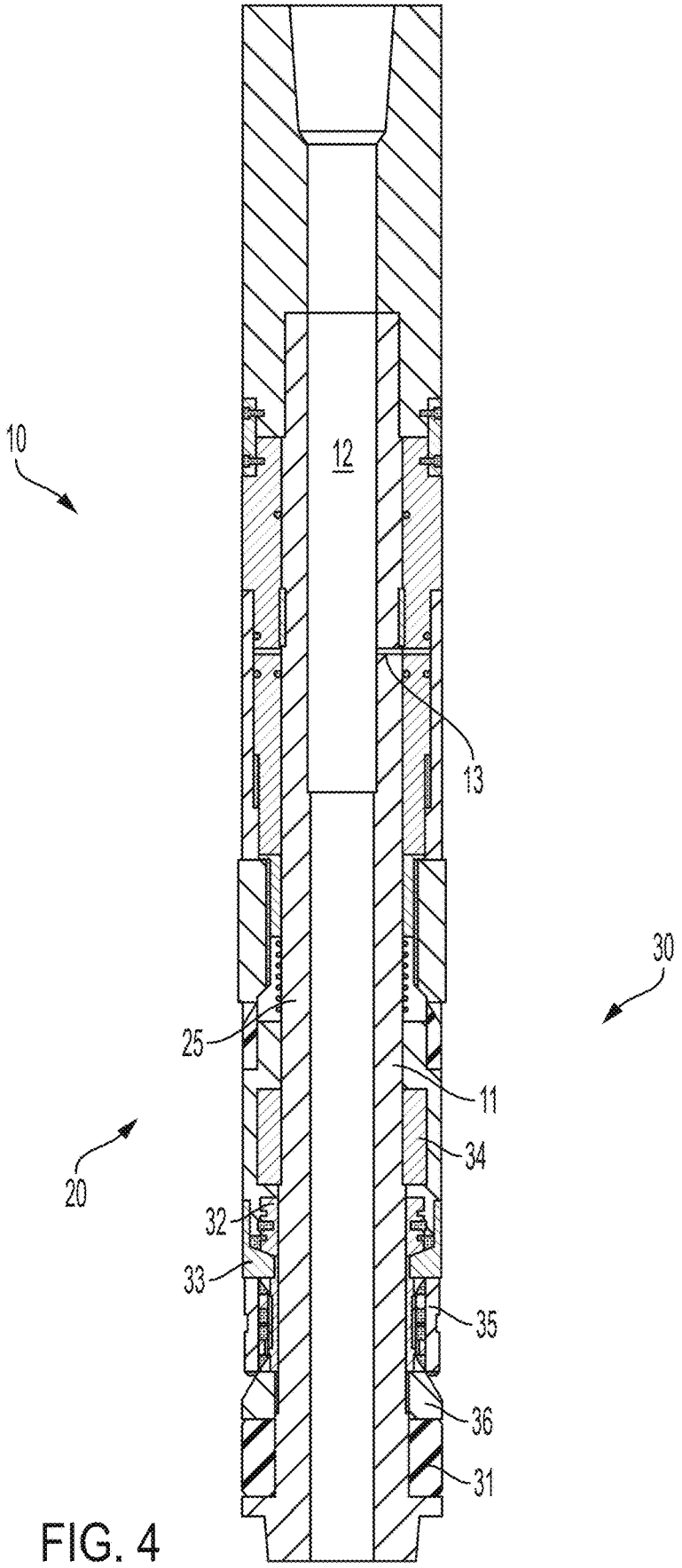
FIG. 4 shows an embodiment of the spear and packer tool that includes a second set of slips between the anchor mechanism and the packer element.

In an embodiment (please see FIG. 4) of the spear and packer tool 10, the tool further comprises a second set of slips 35 and a separation ramp ring 36. This second set of slips 35 is arranged to engage the casing 2 by applying left-hand rotation to the mandrel 11 when the slips segments 22 are engaged with the casing 2. The second set of slips 35 is arranged around the mandrel 11 between the compresser ring 33 and the packer element 31 and with the separation ramp ring 36 between the second set of slips 35 and the packer element 31. When left-hand rotation is applied to the mandrel 11 the segmented ring 32 moved in the distal direction pushing the compresser ring 33 distally. The compresser ring 33 pushes the second set of slips 35 in the distal direction so that the second set of slips 35 is moved onto the ramp of the separation ramp ring 36. The second set of slips 35 is then pushed outwards on the ramp to engage the inner surface of the casing 2. The separation ramp ring 36 will also move in the distal direction along the mandrel 11 so that the packer element 31 is compressed.

Figure 1:
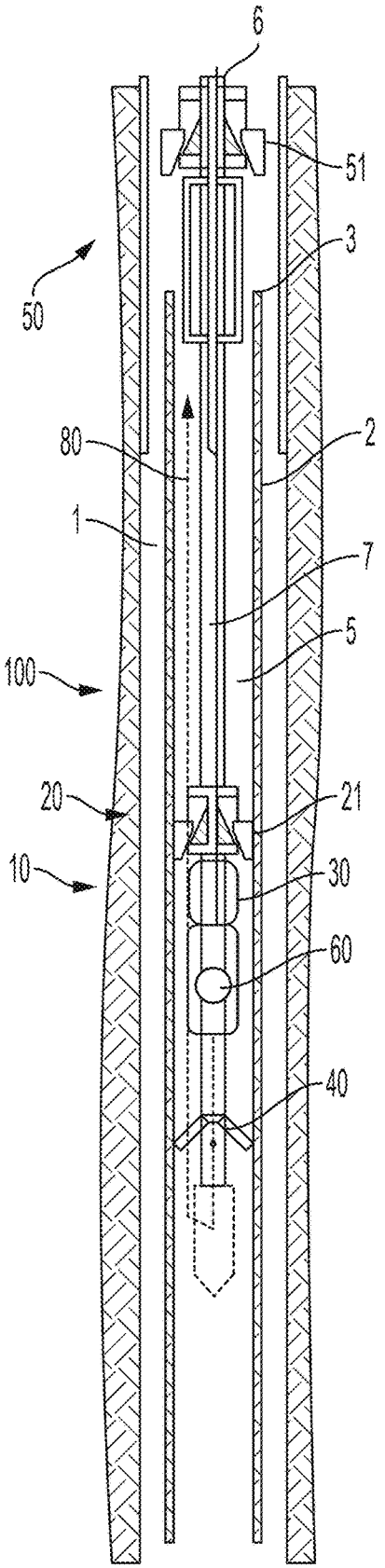
FIG. 1 shows the downhole casing cutting and retrieval assembly located on a work string.
Figure 2:
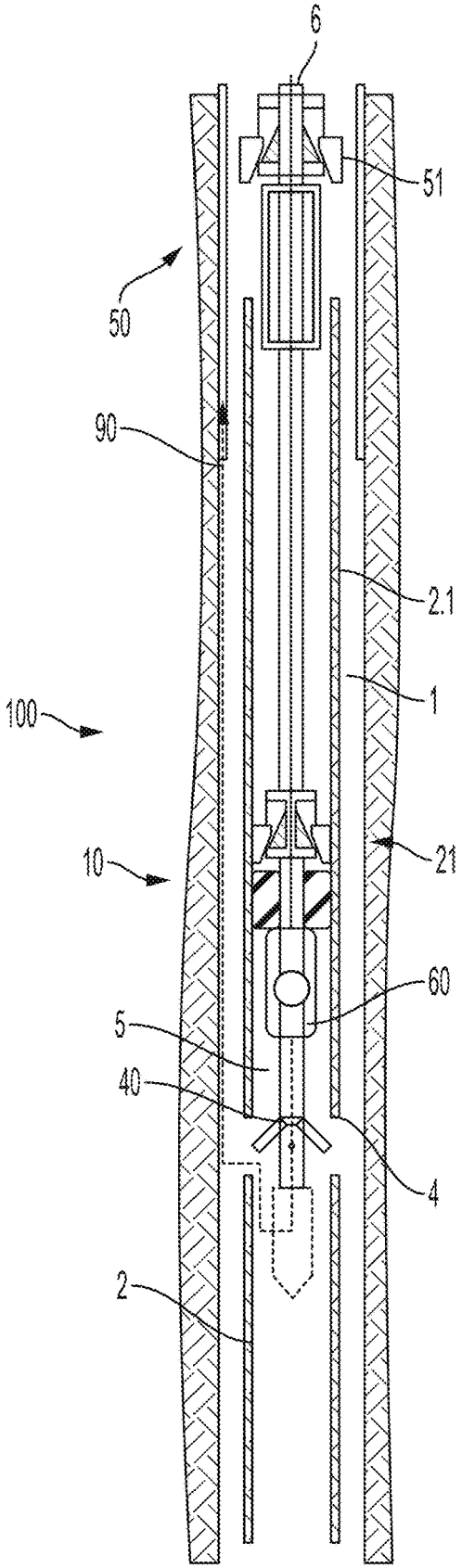
FIG. 2 shows the downhole casing cutting and retrieval assembly at a later point in the operation compare to FIG. 1. Now the cut is made and the packer element is sealing off the tool annulus so that any fluid pumped down the workstring will have to return to surface via the casing annulus, i.e. out through the cut and via the annulus behind the cut off casing section.

In an embodiment of the invention the spear and packer tool 10 is used in a downhole casing cutting and retrieval assembly 100 located on a workstring 6, as seen in FIGS. 1 and 2. This bottom hole assembly further comprises a cutter mechanism 40, a downhole jack 50 and a ball valve tool 60. The tools are spaced out appropriately with drill pipe, crossovers and pup joints. In FIGS. 1 and 2, the arrow 80 indicates circulation path before casing 2 is cut and packer element is set, and the arrow 90 indicates circulation path after casing 2 is cut and packer element is set.

The cutter mechanism is preferably located at or close to the bottom of the assembly 100 and arranged to cut the casing 2 by right-hand rotation of the workstring 6.

In an embodiment of the invention the downhole jack 50 is positioned above the spear and packer tool 10. The downhole jack 50 comprises a jack anchor 51 configured to grip a relative outer casing 8 above a top of the casing 2 to be cut and retrieved. The downhole jack 50 can be operated by increasing the fluid pressure in the through bore 7 of the workstring 6 from a proximal end. An increase above a certain level will set the jack anchor 51 in the outer casing 8. Further increase will activate the jacking action so that the spear and packer tool 10 distal to the jack anchor 51 is pulled proximally towards the jack anchor 51.

An advantage of having the second set of slips 35 is that it is now possible to keep the grip of the spear and packer tool 10 using the second set of slips engaged, while releasing pressure which will release the jack, release the jack anchor, and thus release the upward pull on the primary slips 22 while stroking back the jack and anchor to reset the jack for a new stroke. This makes the toolstring more efficient and assures not losing the proper position for engaging the slips 22 in the cut-off casing. Pulling too high or too low may pose a risk to the operation.

In an embodiment the ball valve tool 60 is arranged between the cutter mechanism 40 and the spear and packer tool 10. The ball valve tool 60 comprises at least one ball valve that can be closed on demand to seal off the through bore 7. Closing off the through bore 7 will make it possible to increase the pressure in the through bore 7 to operate the downhole jack anchor 51 and the jack 50.

The spear and packer tool 10 and the downhole casing cutting and retrieval assembly 100 can be used in a method for cutting a casing 2, and retrieving the resulting cut-off casing section 2.1.

The spear and packer tool 10 is assembled in a bottom hole assembly 100 together with the cutter mechanism 40, the down hole jack 50 and the ball valve tool 60. The assembly is run in hole on a workstring 6.

The cutter mechanism 40, the ball valve tool 60 and the spear and packer tool 10 is run in through the top portion 3 of the casing 2 to be cut. A no-go spaced out above the spear and packer tool 10 and below the downhole jack 50. The purpose of the no-go is to locate the spear portion of the spear and packer tool 10 relative to the top portion 3 of the casing 2.

When the assembly 100 is positioned on the desired depth for cutting, fluid is pumped down the workstring 6 to set the slips segments 21. After the slips segments 21 are extended by operating the differential pressure piston, the workstring 6 is set in tension so that the slips segments 21 are locked in engagement with the casing 2.

Right-hand rotation is applied to the workstring to cut the casing.

After the cut is made right hand rotation is stopped and the workstring 6 is rotated left-hand to set the packer assembly 30 to seal off the tool annulus 5.

With the casing 2 cut and the packer element 31 extended a pressure-/circulation-test can be performed to get an indication on whether the cut off casing section 2.1 is loose or stuck. Fluid, in most cases drilling mud, is pumped down the through bore 7 of the workstring 6. Since the tool annulus 5 is sealed off between the top portion 3 of the cut off casing section 2.1 and the cut 4 fluid will have to return to surface on the outside of the cut off casing section 2.1. If circulation is established it is an indication that the cut off casing section 2.1 can be retrieved. If no circulation is established, it should be evaluated whether another, more proximal cut nearer to the top of the casing 2 should be made, or if the downhole jack 50 should be used to free the cut off casing section.

In case the downhole jack 50 is to be used the packer element 31 must be retracted by applying right-hand rotation to the mandrel 11 via the workstring 6. Next the assembly 100 will be pulled proximally until the spear 20 is at a proper pulling position inside and near the top portion 3 of the cut off casing section 2.1, where the spear 20 is again set.

In the case where the spear and packer tool 10 is provided with the second set of slips 35, this second set of slips 35 will now be set to engage the cut off casing section 2.1. The purpose for setting the second set of slips 35 is to secure the spear 20 so that the slips segments 21 of the spear 20 will not lose its grip if tension in the workstring 6 is released while operating the downhole jack 50. With the second set of slips 35 set, the spear and packer tool 10 is axially fixed in the cut off casing section 2.1. Advantageously, the spear is now locked in its grip even when tension is released in the workstring 6 at the same time as there is no circulation or too low circulation through the through bore 7.

In an embodiment of the invention, when the spear 20 is engaged in the top portion 3 of the cut off casing section 2.1 the ball valve tool 60 is closed. The closing of the ball valve tool 60 can be done by establishing a predefined circulation rate in the through bore 7. This is in case the ball valve tool 60 is a ball valve tool that is operated by a differential pressure piston in the tool.

When the ball valve tool 60 is closed the fluid pressure in the through bore 7 can be increased from surface to first sett the jack anchor 51 in the wider, surrounding casing 8 and then stroke the downhole jack 50 so that the spear 20 is pulled towards the jack anchor 51. The downhole jack 50 might have to be operated several times to pull the cut off casing section 2.1 free.

The invention claimed is:

1. A spear and packer tool:

said tool arranged for being conveyed on a drill pipe string;

said tool having a mandrel having a through bore;

a spear anchor mechanism arranged to grip a section of a casing in a wellbore for removal therefrom, said spear anchor mechanism being arranged to be set by differential pressure, said mandrel being rotatable relative to the spear anchor mechanism; and a packer assembly being a mechanical rotational-set retrievable packer configured to seal an annulus between the tool and the casing, said packer assembly being arranged to be set by applying left-hand rotation to the mandrel while slips segments are engaging the casing, said packer assembly being arranged below the spear anchor mechanism, wherein the packer assembly comprises:

a compresser sleeve arranged slidable on the mandrel;

a ring-shaped packer element encircling the mandrel to be compressed axially to expand to seal the annulus;

a segmented ring moveable relative to the mandrel; and a stopper element being fixed to the mandrel in an axial direction to limit proximal movement of the segmented ring.

2. The spear and packer tool according to claim 1, wherein the slips segments are arranged to engage an inner surface of the casing to be removed; and wherein the spear anchor mechanism comprises:

a ramp assembly arranged to force the slips segments radially outwards when axially forced;

a differential pressure piston arranged to force the slips segments axially towards and onto the ramp assembly as a result of a pressure increase via a radial channel from the through bore; and a bias element arranged to return said differential pressure piston to enable said slips segments to disengage from said casing.

3. The spear and packer tool according to claim 2, wherein the packer element is arranged between a stop flange on the mandrel and the compresser sleeve;

wherein a segmented ring comprises:

three or more ring segments, having ring treads on an inner surface, the ring treads arranged for being threaded onto matching mandrel threads on an outside of the mandrel;

means for rotationally locking the segmented ring to the slips segments, so that the segmented ring is screwed when the mandrel is rotated relative to the slips segments to axially move the segmented ring along the mandrel; and a biasing member encircling the segmented ring to hold the ring segments together with a radially inward biasing force; and wherein the ring threads have a slanted face arranged to face an opposite corresponding slanted face on the mandrel threads, so that when the segmented ring is screwed and moves proximally and hits the stopper element, the ring threads disengages from the underlying mandrel threads.

4. The spear and packer tool according to claim 2, wherein the tool comprises a second set of slips, the second set of slips being arranged to be set by the same left-hand rotation of the mandrel as the packer assembly.

5. A downhole casing cutting and retrieval assembly located on a workstring, having a bore therethrough, comprising:

the spear and packer tool according to claim 2; and a cutter mechanism configured to cut the casing, to separate a cut-off casing section from the casing, the cutter mechanism being arranged below the spear and packer tool.

6. The spear and packer tool according to claim 1, wherein the packer element is arranged between a stop flange on the mandrel and the compresser sleeve;

wherein the segmented ring comprises:

three or more ring segments, having ring treads on an inner surface, the ring treads arranged for being threaded onto matching mandrel threads on an outside of the mandrel;

means for rotationally locking the segmented ring to the slips segments, so that the segmented ring is screwed when the mandrel is rotated relative to the slips segments to axially move the segmented ring along the mandrel; and a biasing member encircling the segmented ring to hold the ring segments together with a radially inward biasing force; and wherein the ring threads have a slanted face arranged to face an opposite corresponding slanted face on the mandrel threads, so that when the segmented ring is screwed and moves proximally and hits the stopper element, the ring threads disengages from the underlying mandrel threads.

7. The spear and packer tool according to claim 6, wherein the tool comprises a second set of slips, the second set of slips being arranged to be set by the same left-hand rotation of the mandrel as the packer assembly.

8. A downhole casing cutting and retrieval assembly located on a workstring, having a bore therethrough, comprising:

the spear and packer tool according to claim 6; and a cutter mechanism configured to cut the casing, to separate a cut-off casing section from the casing, the cutter mechanism being arranged below the spear and packer tool.

9. The spear and packer tool according to claim 1, wherein the tool comprises a second set of slips, the second set of slips being arranged to be set by the same left-hand rotation of the mandrel as the packer assembly.

10. The spear and packer tool according claim 9, wherein the second set of slips is arranged around the mandrel between a compresser ring and a separation ramp ring slidably arranged on the mandrel, wherein the second set of slips is arranged so that when the segmented ring is screwed and moving distally, pushing on the compressor ring, the second set of slips are forced radially outwards by the separation ramp ring, and wherein the separation ramp ring is moved distally for compressing the packer assembly.

11. A downhole casing cutting and retrieval assembly located on a workstring, having a bore therethrough, comprising:

the spear and packer tool according to claim 10; and a cutter mechanism configured to cut the casing, to separate a cut-off casing section from the casing, the cutter mechanism being arranged below the spear and packer tool.

12. A downhole casing cutting and retrieval assembly located on a workstring, having a bore therethrough, comprising:

the spear and packer tool according to claim 9; and a cutter mechanism configured to cut the casing, to separate a cut-off casing section from the casing, the cutter mechanism being arranged below the spear and packer tool.

13. A downhole casing cutting and retrieval assembly located on a workstring, having a bore therethrough, comprising:

the spear and packer tool according to claim 1; and a cutter mechanism configured to cut the casing, to separate a cut-off casing section from the casing, the cutter mechanism being arranged below the spear and packer tool.

14. The downhole casing cutting and retrieval assembly according to claim 13, wherein the mandrel is arranged to be left-hand rotated in order to set the packer assembly, and wherein the mandrel is further arranged to be right-hand rotated in order to unset the packer assembly and connected to the cutter mechanism which is arranged to cut the casing with right-hand rotation of the workstring.

15. The downhole casing cutting and retrieval assembly according to claim 14, wherein the downhole casing cutting and retrieval assembly further comprises a downhole jack comprising a jack anchor arranged to grip an outer casing above a top of said cut-off casing section, the jack being arranged to pull free the cut-off casing section, by pulling the engaged spear anchor mechanism towards the set jack anchor when the spear anchor mechanism is set in the cut-off casing section.

16. The downhole casing cutting and retrieval assembly according to claim 13, wherein the downhole casing cutting and retrieval assembly further comprises a downhole jack comprising a jack anchor arranged to grip an outer casing above a top of said cut-off casing section, the jack being arranged to pull free the cut-off casing section, by pulling the engaged spear anchor mechanism towards the set jack anchor when the spear anchor mechanism is set in the cut-off casing section.

17. The downhole casing cutting and retrieval assembly according to claim 16, wherein a ball valve tool is arranged below the spear and packer tool and above the cutter mechanism, closing the ball valve tool after cutting enables setting pressure in the drill pipe string to operate said downhole jack and jack anchor to pull free the cut-off casing section.

18. A method for cutting a casing, and retrieving a cut-off casing section, wherein the method comprises the steps of:

a) running the downhole casing cutting and retrieval assembly according to claim 13, on the workstring into the wellbore;

b) entering a top portion of a casing to be cut and retrieved with the casing cutting and removal assembly;

c) pressure setting the anchor mechanism of the spear in the casing by pumping in said workstring with a flowrate above a predetermined level;

d) holding the workstring in tension to keep the slips segments of the spear anchor mechanism engaged to the casing;

e) rotating the workstring in a right-hand direction to cut the casing, while circulating well fluid via the tool annulus past said anchor mechanism;

f) when said casing is cut, stopping the right-hand rotation of the workstring;

g) rotating the workstring in the left-hand direction to set the packer assembly;

h) setting pressure in said workstring; and i) monitoring pressure and returning flow from the wellbore for the purpose of evaluating whether the cut-off casing section is free.

19. The method for cutting and retrieving a casing according to claim 18, wherein the method further comprises the steps of:

j) releasing the spear anchor mechanism and the packer mechanism if not previously released;

k) pulling the casing cutting and retrieval assembly proximally until the spear anchor mechanism is in the top portion of the cut-off casing section;

l) setting the spear anchor mechanism in the top portion of the cut-off casing section;

m) determining whether the cut-off casing section is stuck in its casing annulus by pulling on the workstring from surface;

n) setting the jack anchor in an outer casing above said top portion of said cut-off section; and o) operating the jack tool for pulling the spear anchor mechanism, for pulling the cut-off casing section, towards the jack anchor.

20. The method for cutting and retrieving a casing according to claim 18, wherein the packer assembly is retracted by applying right-hand rotation to the mandrel via the workstring.

* * * * *